US010352017B1

(12) United States Patent
Granger et al.

(10) Patent No.: US 10,352,017 B1
(45) Date of Patent: Jul. 16, 2019

(54) MANHOLE COVER ASSEMBLY

(71) Applicant: EMCO WHEATON RETAIL CORPORATION, Wilson, NC (US)

(72) Inventors: Matthew Steven Granger, Raleigh, NC (US); James L. Lawrence, Wilson, NC (US)

(73) Assignee: EMCO WHEATON RETAIL CORPORATION, Wilson, NC (US)

( * ) Notice: Subject to any disclaimer, the term of this patent is extended or adjusted under 35 U.S.C. 154(b) by 0 days.

(21) Appl. No.: 15/967,648

(22) Filed: May 1, 2018

(51) Int. Cl.
*E02D 29/14* (2006.01)

(52) U.S. Cl.
CPC ..... *E02D 29/14* (2013.01); *E02D 29/1445* (2013.01)

(58) Field of Classification Search
CPC ..... E02D 29/14; E02D 29/1445
USPC ..... 52/20
See application file for complete search history.

(56) References Cited

U.S. PATENT DOCUMENTS 1,102,422 A * 7/1914 McKeon ..... E01F 13/085 49/35
2,655,280 A * 10/1953 Cuttell ..... B01L 3/50825 215/307
3,408,778 A * 11/1968 Mason ..... E02D 29/14 404/26
4,650,365 A * 3/1987 Runnels ..... E02D 29/14 404/25
4,890,425 A * 1/1990 Mamula ..... E02D 31/02 52/169.5
4,973,191 A * 11/1990 Dannhauser ..... G09F 19/22 404/25
4,976,568 A * 12/1990 Hess ..... E02D 29/1409 404/25
5,549,411 A * 8/1996 Hawkins ..... E02D 29/14 404/25
5,628,152 A * 5/1997 Bowman ..... B65D 90/105 137/364

(Continued)

FOREIGN PATENT DOCUMENTS

CH 624444 A5 * 7/1981 ..... E05D 29/1409

OTHER PUBLICATIONS

A0716 Composite Manholes brochure, 2 pages, published more than one year prior to the filing date of the subject patent application (NPL1).

*Primary Examiner* — Jeanette E Chapman
(74) *Attorney, Agent, or Firm* — Merek, Blackmon & Voorhees, LLC

(57) ABSTRACT

A manhole cover assembly removably supported by a manhole skirt or rim wherein when the manhole cover assembly is removed from the manhole skirt or rim an individual can access one or more components (e.g., underground fuel storage tank) through an opening in the manhole skirt or rim. Preferably, the manhole cover assembly is light weight and very strong so that there is little or no deflection of the cover of the manhole cover assembly when subjected to a predetermined load. Preferably, the manhole cover assembly is adapted for use in refueling stations to withstand the load placed thereon when a refueling tanker or other vehicle runs over the manhole cover assembly with little or no deflection of the cover of the manhole cover assembly. Preferably, the assembly forms a liquid tight seal with the manhole skirt to prevent liquid from passing into the storage area below the skirt.

21 Claims, 16 Drawing Sheets

(56) References Cited

U.S. PATENT DOCUMENTS

| | | | | |
|---|---|---|---|---|
| 6,267,261 | B1 * | 7/2001 | Lesage | F24H 1/182<br>220/567.3 |
| 6,464,435 | B1 * | 10/2002 | Chen | B23B 31/265<br>184/6.14 |
| 7,914,227 | B2 | 3/2011 | Jordan et al. | |
| 9,004,809 | B2 | 4/2015 | Stoltenberg | |
| 2008/0050175 | A1 * | 2/2008 | Brady | E02D 29/124<br>404/25 |
| 2012/0247987 | A1 * | 10/2012 | Patterson | G01F 15/14<br>206/305 |

* cited by examiner

MANHOLE COVER ASSEMBLY

FIELD OF THE INVENTION

A preferred form of the present invention is directed to a manhole cover assembly removably supported by a manhole skirt or rim wherein upon removal of the manhole cover assembly an individual can access one or more components (e.g., underground fuel storage tank) through an opening in the manhole skirt or rim. The preferred forms of manhole cover assemblies are designed to be light weight and very strong so that there is little or no deflection of the cover of the manhole cover assembly when a predetermined load is applied thereto. Preferred forms of the manhole cover assemblies are adapted for use in refueling stations to withstand the load placed thereon when a refueling tanker or other vehicle runs over the manhole cover assembly with little or no deflection of the cover of the manhole cover assembly. Preferred forms of the manhole cover assemblies form a liquid tight seal with the corresponding manhole skirt or rim to prevent liquid from passing downwardly between the manhole cover assembly and the manhole skirt or rim and into the storage area below the manhole skirt or rim.

BACKGROUND OF THE INVENTION

Manhole covers are widely used in service stations to allow individuals to access various components (e.g., underground fuel storage tanks) of fuel transfer systems located below grade level. A significant concern surrounding manhole covers is the overall weight of the manhole cover as the manhole cover must be repeatedly removed throughout any given year so that an individual can access a component of the fuel transfer system stored below the manhole cover. Many prior art manhole covers are relatively heavy which can result in injury to an individual during the removal process. While manhole covers have been formed from a composite material to reduce the overall weight of the cover, such covers are typically subject to considerable deflection when loaded by, for example, a wheel of a refueling tanker or other vehicle. Further, other relatively light weight covers do not evenly distribute the load across the area of the manhole cover assembly which can lead to premature failure of the manhole cover. Some relatively light weight covers require introduction of foam into the interior of the manhole cover wherein the foam is needed to provide the necessary structural stability to the manhole cover.

Accordingly, there exists a need for a manhole cover assembly that is lightweight, experiences little or no deflection of the cover when loaded, is free of structural foam and/or evenly distributes the load across the manhole cover assembly.

OBJECTS AND SUMMARY OF THE INVENTION

An object of the present invention is to provide a novel and unobvious manhole cover assembly.

Another object of a preferred embodiment of the present invention is to provide a manhole cover assembly that is light weight yet strong enough to prevent or significantly reduce deflection of the manhole cover when loaded by, for example, a wheel of a refueling tanker or other vehicle.

A further object of a preferred embodiment of the present invention is to provide a manhole cover assembly where no portion of the surface area of the cover is subject to significant deflection when loaded.

Yet another object of a preferred embodiment of the present invention is to provide a manhole cover assembly that is light weight, not subject to any significant deflection of the cover and does not require the introduction of structural foam into the interior to prevent deflection of the cover.

Still a further object of a preferred embodiment of the present invention is to provide a manhole cover assembly that is designed to evenly distribute a load across the manhole cover assembly.

It must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

In summary, one preferred embodiment of the present invention is directed to a manhole cover assembly configured to be removably supported by a manhole skirt wherein upon removal of the manhole cover assembly an individual can access one or more components through an opening formed by the manhole skirt. The manhole cover assembly includes a cover having an upper surface configured to cover at least a major area of the opening formed by the manhole skirt when the manhole cover assembly is installed wherein at least a portion of the cover forms an uppermost portion of the manhole cover assembly. A base supports the cover and is disposed below the upper surface of the cover. The based and the cover are separate pieces. The base has a main body portion forming at least a major portion of the base. The main body portion has a bottom surface. The bottom surface includes an inner surface portion located midway between directly opposing outermost segments of the base. The bottom surface of the main body portion is dome shaped wherein no portion of the bottom surface of the main body portion of the base is planar. The bottom surface of the main body portion forms a lowermost portion of the manhole cover assembly. The manhole cover assembly further includes a plurality of ribs. At least a portion of each of the plurality of ribs is disposed between the upper surface of the cover and the bottom surface of the base, wherein the manhole cover assembly is configured to prevent deflection of the cover when a predetermined load is applied to the cover and each of the plurality of ribs are loading bearing ribs.

Another preferred embodiment of the present invention is directed to a manhole cover assembly configured to be removably supported by a manhole skirt wherein upon removal of the manhole cover assembly an individual can access one or more components through an opening formed by the manhole skirt. The manhole cover assembly includes a cover having an upper surface configured to at least substantially cover the opening formed by the manhole skirt when the manhole cover assembly is installed, wherein at least a portion of the cover forms an uppermost portion of the manhole cover assembly. The cover includes a plurality of ribs. Each of the plurality of ribs has a curved bottom surface. A base supports the cover. The based is disposed below the upper surface of the cover. The based and the cover are separate pieces. The base has a main body portion. The main body portion is dome shaped wherein no portion of the main body portion of the base is planar. The main body portion has an inner cavity for receiving the plurality of ribs. A bottom surface of the main body portion forms a lowermost portion of the manhole cover assembly.

A further preferred embodiment of the present invention is directed to a manhole cover assembly configured to be removably supported by a manhole skirt wherein upon removal of the manhole cover assembly an individual can access one or more components through an opening formed by the manhole skirt. The manhole cover assembly includes a cover having an upper surface configured to cover at least a portion of the opening formed by the manhole skirt when the manhole cover assembly is installed, wherein at least a portion of the cover forms an uppermost portion of the manhole cover assembly. The manhole cover assembly further includes a first collar and a second collar. The first collar is disposed in the second collar. The manhole cover assembly further includes a plurality of ribs. Each of the plurality of ribs is a loading bearing rib. The plurality of ribs includes a first rib and a second rib. Each of the first rib and the second rib has an innermost end and an outermost end. The innermost end of the first rib abuts an outer surface of the first collar and the innermost end of the second rib abuts an outer surface of the second collar.

The above summary describes preferred forms of the present invention and is not in any way to be construed as limiting the claimed inventions to the preferred forms.

BRIEF DESCRIPTION OF THE DRAWINGS

FIG. 1A is a side elevational view of one form of many forms of manhole skirts/rims that the preferred embodiment of FIG. 1 can be used with.

The above figures depict preferred forms of the present invention. Numerous modifications of the preferred forms depicted in FIGS. 1 to 30 are well within scope of the present invention. For example, while a circular manhole cover assembly and circular skirt/rim are depicted, the manhole cover assembly and the corresponding skirt/rim can take many different forms including square, rectangular, triangular, etc. Hence, none of the figures are to be used to limit the claimed invention to any configuration illustrated in the above figures.

DETAILED DESCRIPTION OF THE PREFERRED EMBODIMENTS OF THE INVENTION

The preferred forms of the present invention will now be described with reference to FIGS. 1-30. The appended claims are not limited to the preferred forms and no term and/or phrase used herein is to be given a meaning other than its ordinary meaning unless it is expressly stated otherwise.

FIGS. 1 to 16

Referring to FIGS. 1 to 16, one of many different forms of manhole cover assembly A formed in accordance with a preferred embodiment of the present invention is depicted. The manhole cover assembly A is preferably light weight and strong to prevent or significantly reduce deflection of the cover when subject to a load. The one or more components of the manhole cover assembly A can be formed from any suitable material including aluminum and SMC. SMC can be manufactured by dispersing long strands (usually >1 inches) of chopped fiber (commonly glass fibers or carbon fibers on a bath of thermoset resin (commonly polyester resin, vinyl ester or epoxy resin)).

Figure 1:
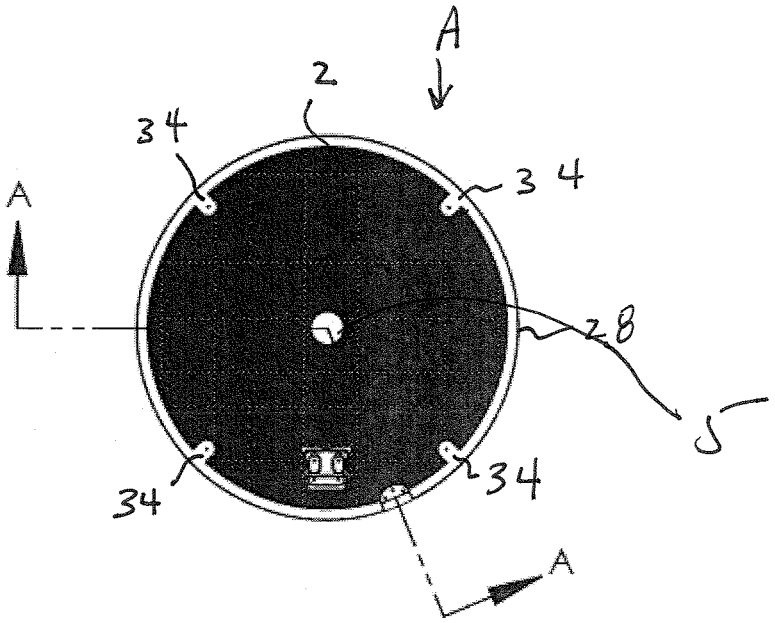
FIG. 1 is a top plan view of one preferred form of manhole cover assembly formed in accordance with a preferred embodiment of the present invention.
Figure 1A:
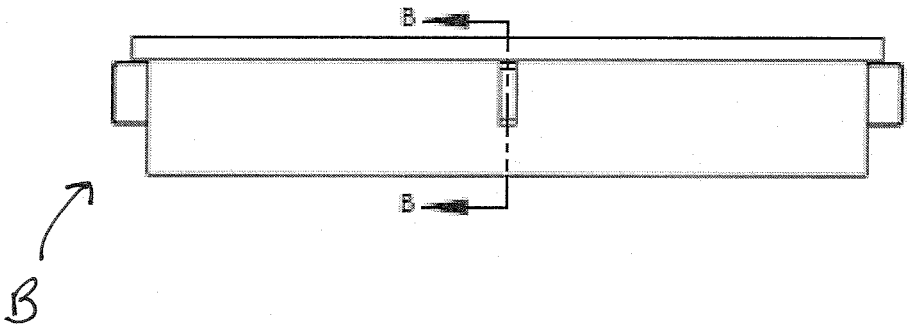
Figure 1B:
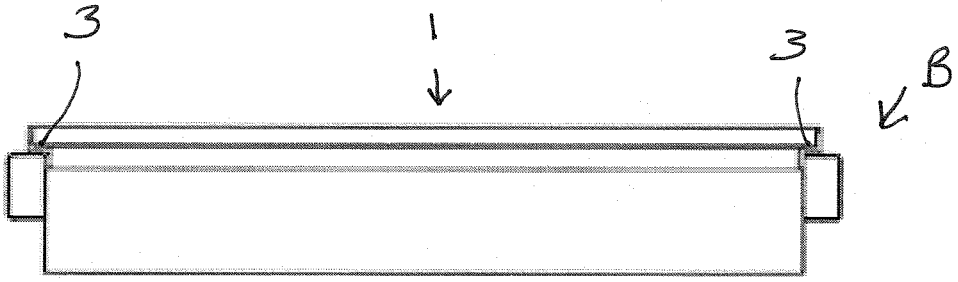
FIG. 1B is a cross-sectional elevational view of the manhole skirt/rim taken along lines B-B of FIG. 1A.
Figure 2:
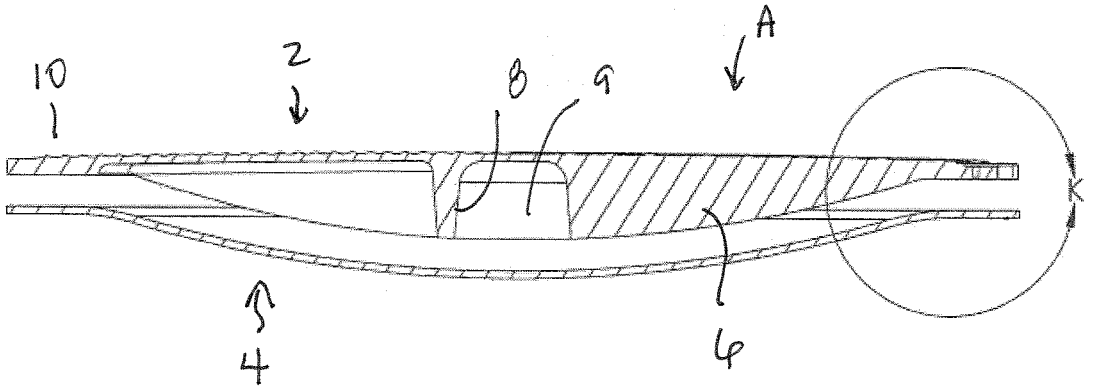
FIG. 2 is a cross-sectional view of taken along lines A-A in FIG. 1 with the base spaced from the cover to better illustrate these two components.
Figure 2A:
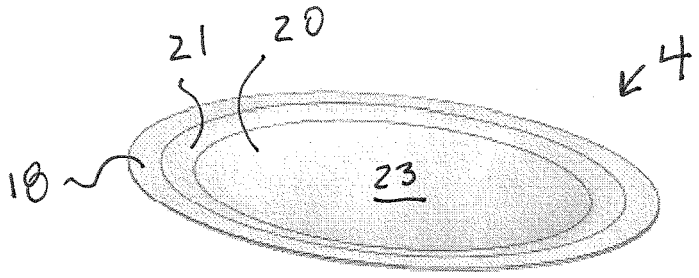
FIG. 2A is a perspective view of a preferred base of the manhole cover assembly depicted in FIG. 1.
Figure 2B:
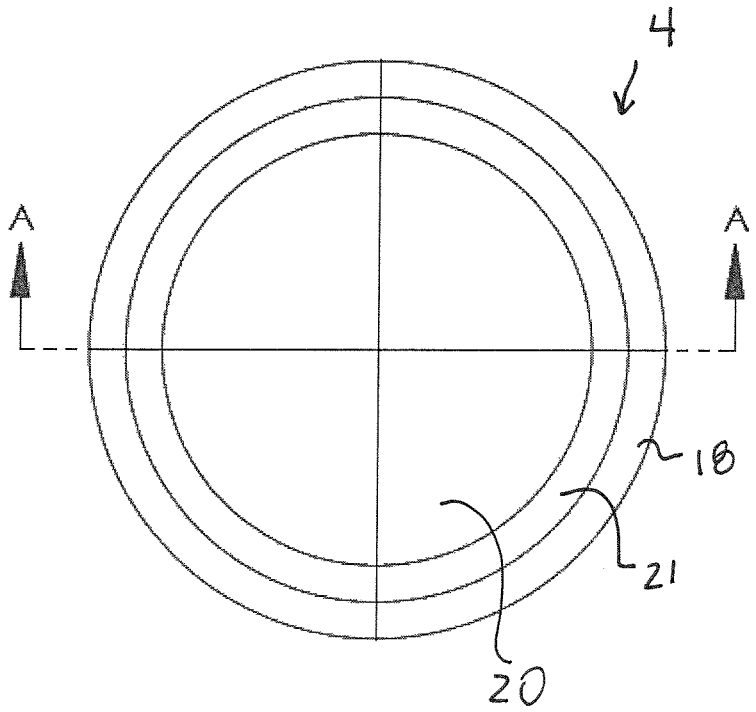
FIG. 2B is a top plan view of the preferred base of FIG. 2A.
Figure 2C:
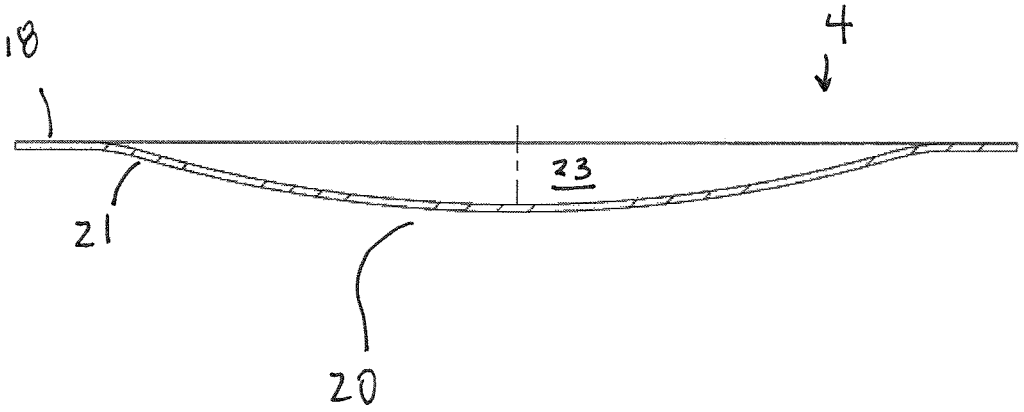
FIG. 2C is a cross-sectional view of taken along lines A-A in FIG. 2B.

FIGS. 1A and 1B depict one of many different forms of manhole skirt/rim B that the present invention can be supported by when installed in an operating position in a refueling station or other suitable environment. The manhole skirt/rim B as depicted is circular and forms a circular opening 1 that allows an individual to access an area below the manhole skirt/rim B upon removal of the manhole cover assembly A. One environment in which the manhole cover assembly can be used is in refueling stations where vehicles refuel. Upon removal of the manhole cover assembly A, the manhole skirt/rim B can allow an individual to access one or more components of a fuel transfer system (e.g., an underground fuel storage tank). While manhole cover assembly A and manhole skirt/rim B are shown as having a circular configuration, these components can take any desired configuration including but not limited to square and rectangular.

Preferably, manhole cover assembly A is formed from multiple pieces (i.e., at least two separate pieces) and includes a cover 2 and a base 4. Cover 2 and base 4 can be formed as separate pieces from any suitable material including but not limited to aluminum and SMC. When installed in an operating position, cover 2 of the manhole cover assembly A is at approximately grade level. Cover 2 may have an arcuate upper surface (i.e., a convex surface as seen from above) to allow liquid run off the edges of cover 2 to the surface of the surrounding environment. However, the upper surface of cover 2 can be configured to form a flat surface or other suitably shaped surface. Cover 2 can include a circular depression 5 formed in the center thereof to receive an identification plate (not shown) attached to cover 2 by an adhesive or any other suitable fastener which identifies the type of fuel stored in the underground storage tank disposed beneath assembly A. Preferably, cover 2 is fixed to base 4 by a suitable adhesive or fasteners such that cover 2 and base 4 are removed as a single unit from skirt/rim B.

Figure 4:
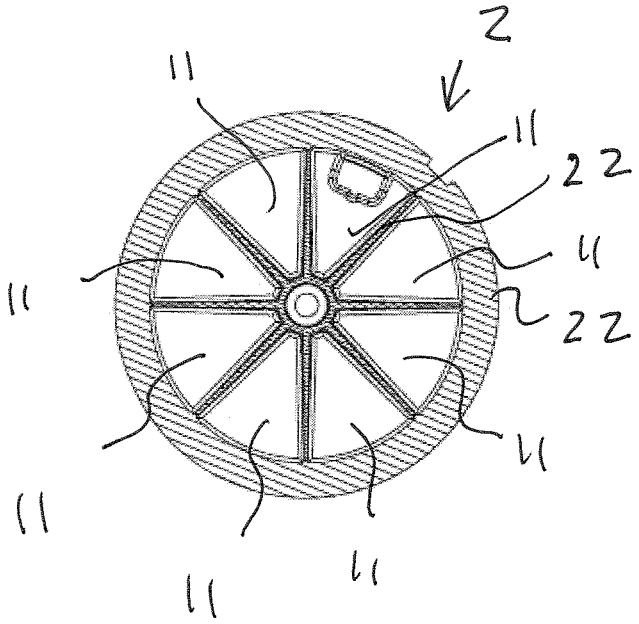
FIG. 4 is a bottom plan view of the manhole cover assembly of FIG. 1 with cross hatching indicating where an adhesive can be applied to the outer peripheral lip and the loading bearing ribs.
Figure 5:
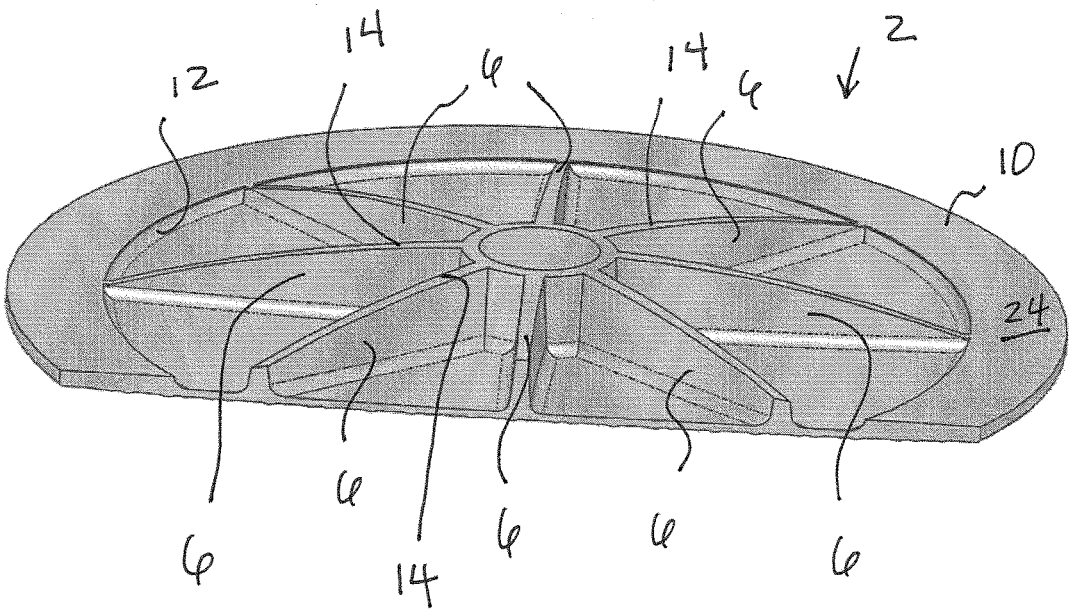
FIG. 5 is a fragmentary perspective view of the cover of the manhole cover assembly of FIG. 1.
Figure 6:
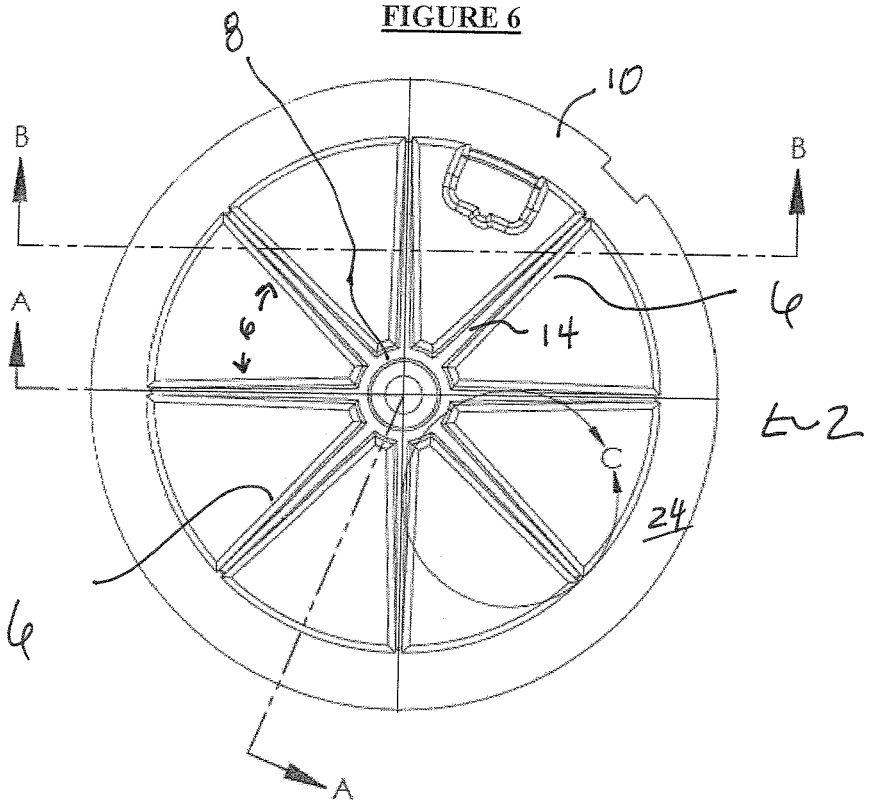
FIG. 6 is a bottom plan of one form of a preferred cover formed in accordance with the present invention.
Figure 7:
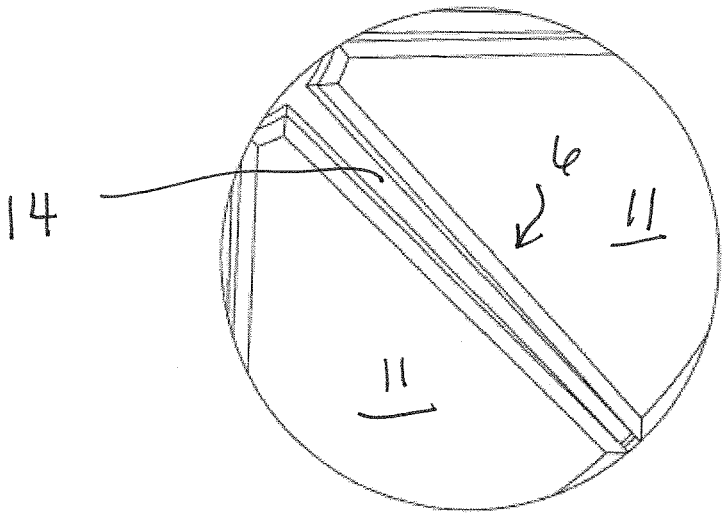
FIG. 7 is an enlarged view of the details of circle C in FIG. 6.
Figure 8:
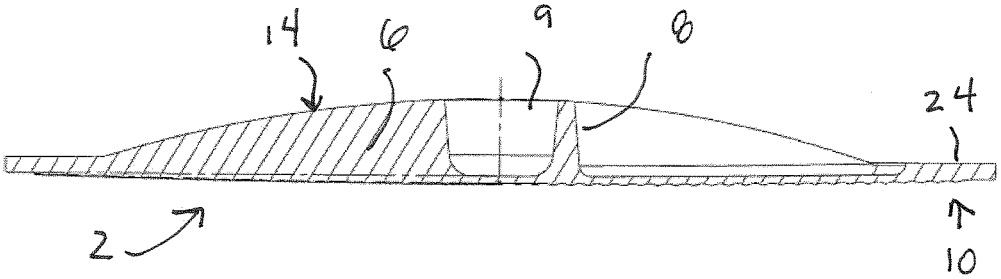
FIG. 8 is a cross-sectional view taken along lines A-A of FIG. 6.
Figure 9:
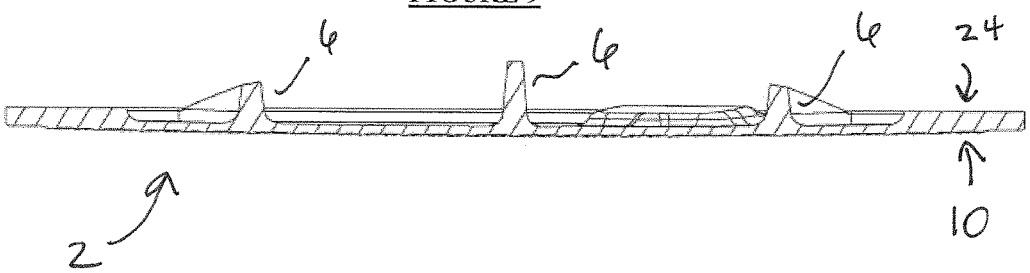
FIG. 9 is a cross-sectional view taken along lines B-B of FIG. 6.

Referring to FIGS. 2 and 4 through 9, cover 2 includes eight radially extending ribs 6 extending outwardly from cylindrical collar 8. Preferably, ribs 6 are uniformly spaced about collar 8. Ribs 6 can be tapered to provide a draft angle (e.g., 5 degrees) to facilitate removal of cover 2 from a mold. It is to be understood that the number and configuration of ribs can be varied as desired. Preferably, collar 8 is hollow defining a hollow central cavity 9. However, collar 8 could be solid without any hollow portions. Cover 2 preferably includes a peripheral lip 10 that extends in a substantially horizontal plane. As seen in FIG. 5, cover 2 further preferably includes a concave (as seen from above) annular section 12 that provides a transitional section between ribs 6 and peripheral lip 10. Cover 2 further includes a planar and horizontally extending surface 11 disposed between adjacent ribs 6.

Each of ribs 6 has a bottom surface 14 that from a bottom vantage point is convex. Preferably, the curvature of bottom surface 14 has a substantially constant radius. In a most preferred form, bottom surface 14 has a radius of R59.06 where cover 2 has a diameter of 43.75 inches. Further, in a most preferred form each of ribs 6 at its lowermost surface is spaced approximately 3.7 inches from an uppermost surface of cover 2. However, the dimensions of cover 2 and its components can be varied as desired.

Referring to FIGS. 2, 2A, 2B and 2C, base 4 includes an outer peripheral lip or portion 18 that defines an outermost portion of base 4. Base 4 includes a main body portion 20 preferably forming a center portion of base 4. Base 4 includes a transitional section 21 that surrounds main body portion 20 and is surrounded by lip 18. Lip 18 is configured to rest on inner annular surface 3 of manhole skirt B. Main body portion 20 is dome shaped (i.e., free of any planar portions/segments) and preferably has an inside radius of R59.06 that is complementary to the radius of the bottom surface of ribs 6. Main body portion 20 forms a hollow cavity 23 that receives ribs 6. Preferably, base 4 has a uniform or substantially uniform thickness. For example, a preferred form of base 4 can have a thickness throughout of 0.315 inches. In a most preferred form, a center of base 4 is approximately 2.7 inches from a bottommost surface of base 4 to a horizontal plane extending through an uppermost surface of base 4. Preferably, transitional section 21 has a radius smaller than the radius of main body portion 20. For example, transitional section 21 can have a radius of R9.37. In a most preferred form, base 4 has a diameter of 43.75 inches. However, all dimensions of base 4 may be varied as desired. Preferably, the upper inner surface and bottom exterior surface of main body portion 20 are non-planar surfaces.

Main body portion 20 of base 4 and ribs 6 transfer evenly the load placed on manhole cover assembly A across manhole cover assembly A. This is accomplished without manhole cover assembly A including any structural foam anywhere including but not limited to the spaces formed between adjacent ribs 6. Preferably, base 4 is approximately 26 pounds and cover 2 is approximately 54 pounds.

Figure 3:
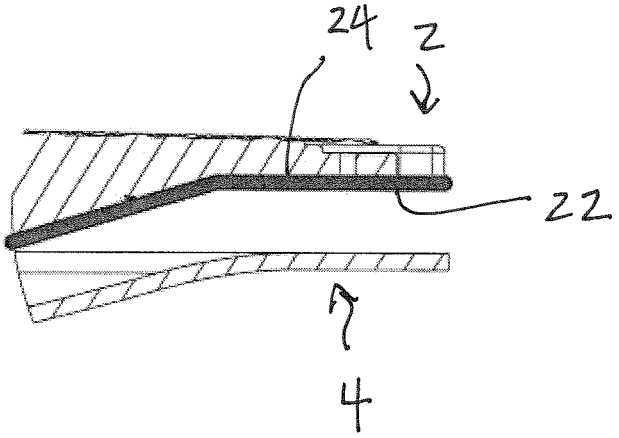
FIG. 3 is an enlarged cross-sectional view of the details of circle K in FIG. 2.

Referring to FIGS. 3 and 4, an adhesive 22 (shown by cross-hatching in FIG. 4) can be applied to lower surface 24 of lip 10 and bottom surface 14 of ribs 6 to fix cover 2 to base 4. In place of or as a supplement to the adhesive one or more fasteners can be used to secure cover 2 to base 4. For example, an externally threaded bolt (not shown) passing through an opening formed in each of lips 10 and 18 along with an internally threaded nut (not shown) can be used to secure cover 2 to base 4.

Figure 11:
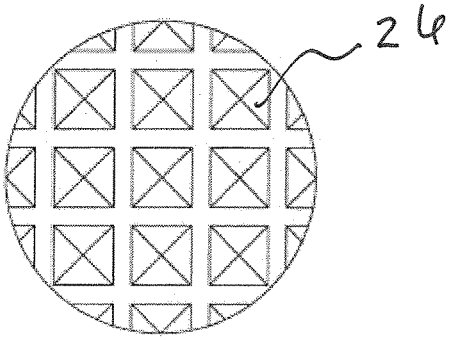
FIG. 11 is an enlarged view of the details of circle D of FIG. 10.

Referring to FIG. 11, cover 2 can be provided with an anti-skid surface that includes pyramid shaped projections 26 extending upwardly that are designed to prevent a person from slipping on cover 2 when the individual walks across cover 2. Referring to FIG. 1, the outermost periphery 28 of cover 2 is free of the anti-skid surface.

Figure 12:
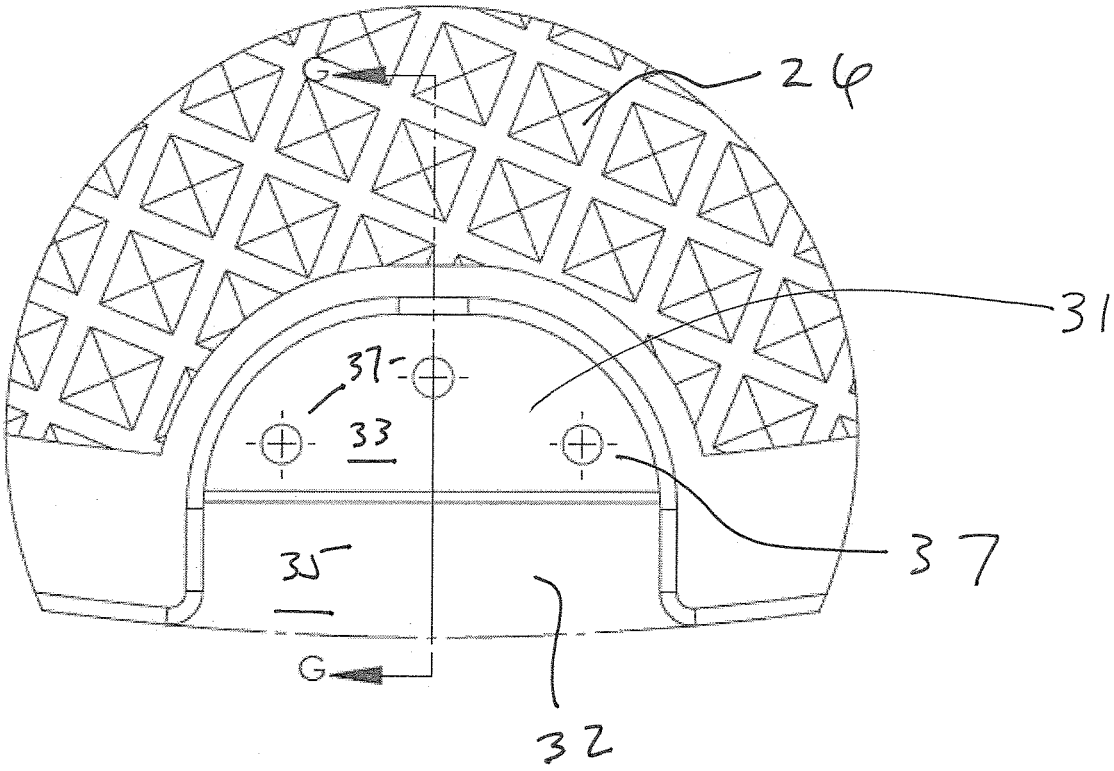
FIG. 12 is an enlarged view of the details of circle E of FIG. 10.
Figure 13:
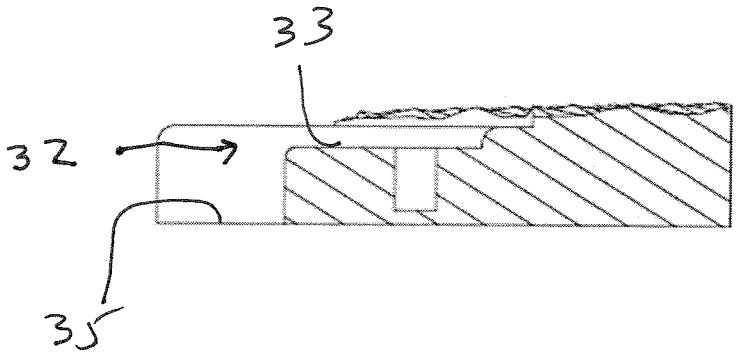
FIG. 13 is a cross-sectional view taken along lines G-G of FIG. 12.
Figure 16:
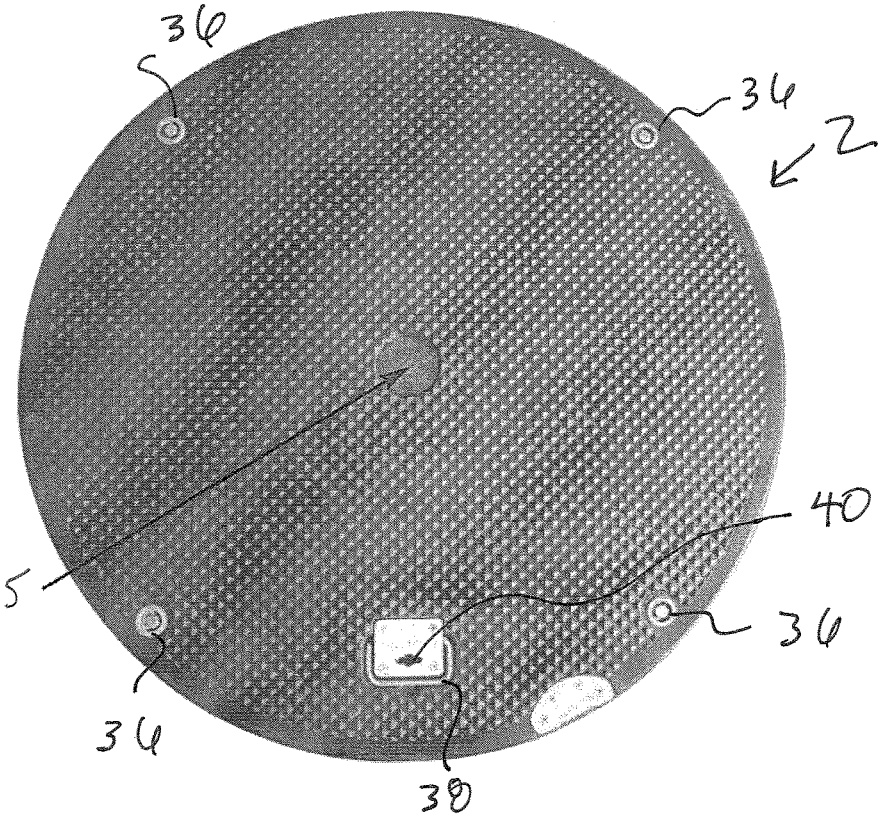
FIG. 16 is a plan view of a cover formed in accordance with a preferred embodiment of the invention showing four locking cams, a lift handle and key-lift assist and a plate that receives a crowbar.
Figure 17:
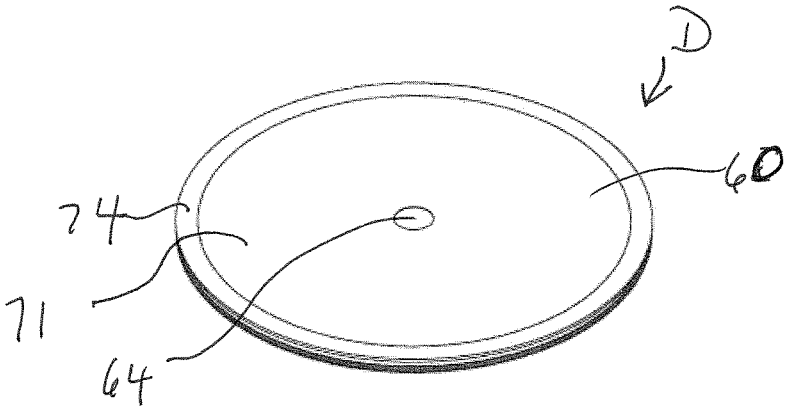
FIG. 17 is a perspective view of another preferred form of manhole cover assembly formed in accordance with the present invention.
Figure 18:
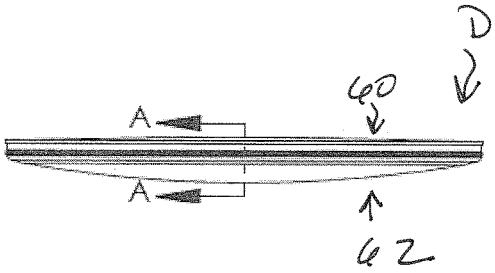
FIG. 18 is an elevational view of the embodiment depicted in FIG. 17.

Referring to FIGS. 12, 13 and 16, cover 2 preferably includes a lift assist plate 30 which can be disposed in stepped recess 31 having an upper surface 33 and a lower surface 35 to create a space 32 below a lower surface of plate 30 that a crowbar can be inserted into and rest against a lower surface of lift assist plate 30 to assist in lifting manhole cover assembly A similar to Emco Wheaton Retail Corporations A0176 composite manhole cover. Internally threaded openings 37 can be formed in surface 33 to receive fasteners to secure plate 30 to cover 2.

Figure 10:
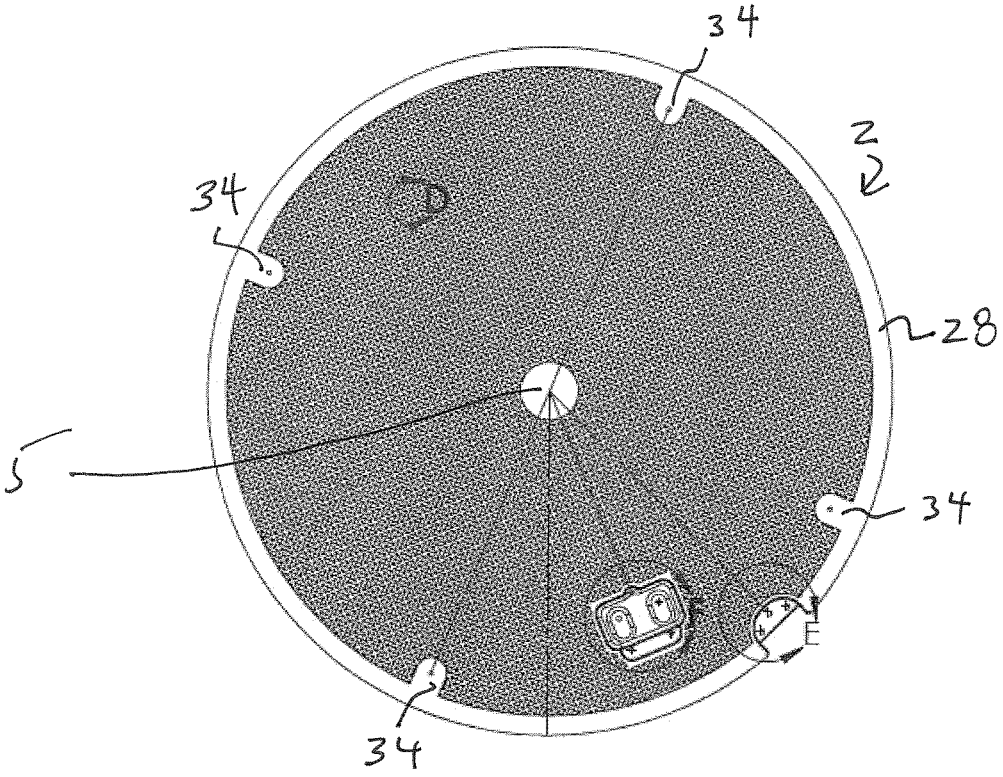
FIG. 10 is a plan view of a cover formed in accordance with a preferred embodiment of the present invention.

Referring to FIG. 16, each of the four openings 34 in cover 2 depicted in FIGS. 1 and 10 can be configured to receive cam locks 36 similar to Emco Wheaton Retail Corporation's A0176 composite manhole cover to secure/lock the manhole cover assembly A to the manhole skirt/rim B.

Figure 14:
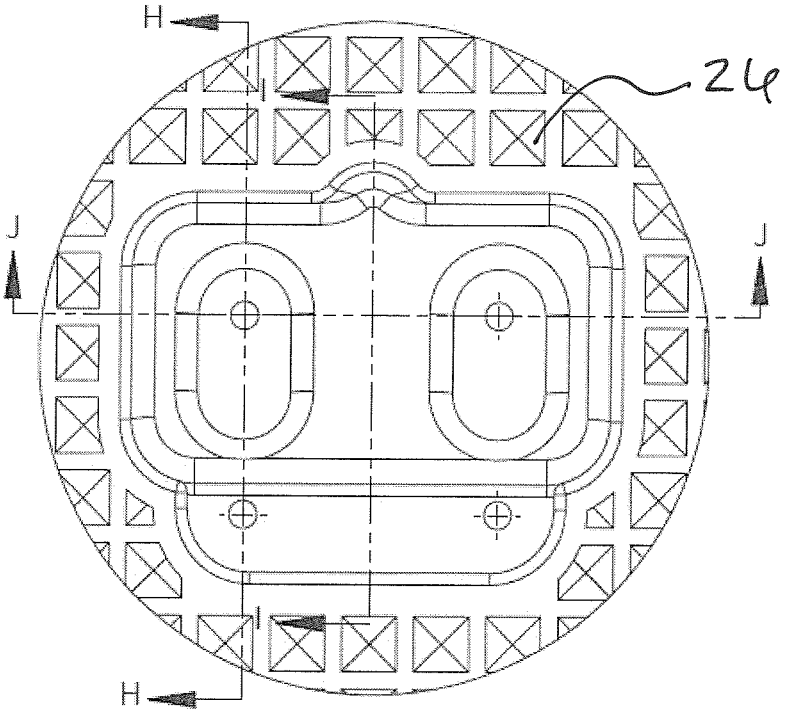
FIG. 14 is an enlarged view of the details of circle F of FIG. 10.
Figure 15:
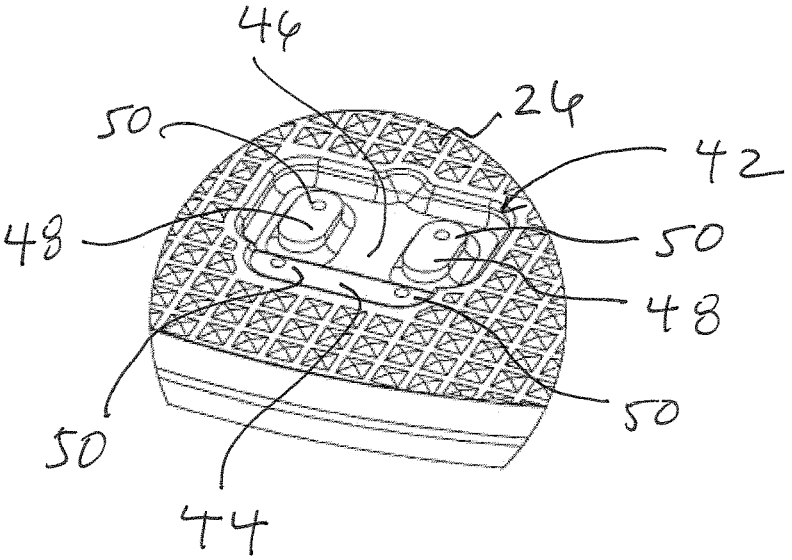
FIG. 15 is an enlarged perspective view of a portion of a cover formed in accordance with a preferred embodiment of the present invention.

Referring to FIGS. 14 to 16, the manhole cover 2 may be provided with a lift handle 38 and a key-lift slotted plate 40 in stepped recess 42 having an upper surface 44, a lower surface 46, and two mounting protrusions 48 similar to Emco Wheaton Retail Corporation's A0176 composite manhole cover to assist in removal of manhole cover assembly A. Lift handle 38 is supported by upper surface 44 and is free to pivot upwardly. Protrusions 48 and upper surface 44 support key-lift slotted plate 40. Internally threaded openings 50 may be formed in upper surface 44 and in each of protrusions 48 to receive fasteners to secure plate 40 to cover 2.

FIGS. 17 to 30

Referring to FIGS. 17 to 30, one of many different forms of manhole cover assembly D formed in accordance with another embodiment of the present invention is depicted. The manhole cover assembly D is preferably light weight (e.g., 100 pounds or less) and strong to prevent or significantly reduce deflection of the cover when subject to a load. The one or more components of the manhole cover assembly D can be formed from any suitable material including aluminum and SMC.

Preferably, manhole cover assembly D is formed from multiple pieces (i.e., at least two separate pieces) and includes a cover 60 and a base 62 which are formed as separate pieces. However, base 62 can be used by itself, for example, to significantly improve the strength of an existing manhole cover installed in a refueling station. Cover 60 and base 62 can be formed from any suitable material including but not limited to aluminum and SMC. Cover 60 as depicted in, for example, FIG. 20 can be formed as a single piece and base 62 as depicted in, for example, FIGS. 24 and 29 may be formed as a single piece but separate from cover 60. When installed in an operating position, cover 60 of the manhole cover assembly D is at approximately grade level. As seen in, for example, FIG. 19, cover 60 may have an arcuate upper surface (i.e., a convex surface as seen from above) to allow liquid run off the edges of cover 60 to a surface of the surrounding environment. However, the upper surface of cover 60 can be configured to form a flat surface or other suitably shaped surface. Cover 60 can include a circular depression 64 formed in the center thereof to receive an identification plate (not shown) attached to cover 60 by an adhesive or any other suitable fastener which identifies the type of fuel stored in the underground storage tank disposed beneath assembly D.

Figure 20:
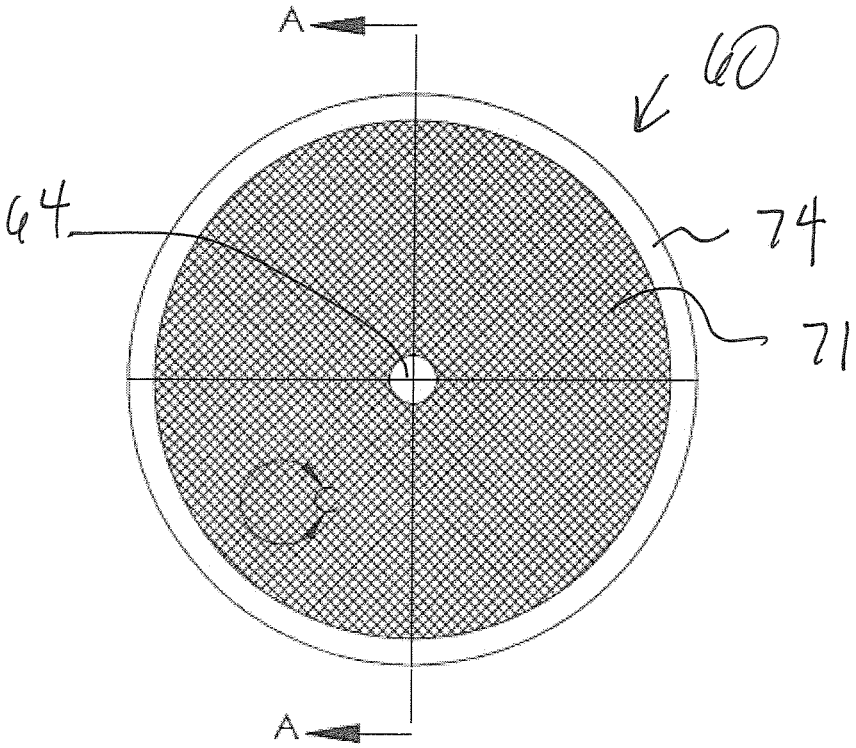
FIG. 20 is a plan view of another preferred cover formed in accordance with invention.
Figure 21:
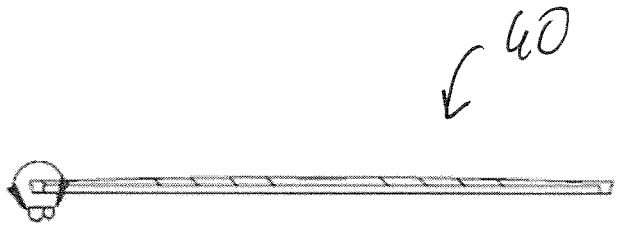
FIG. 21 is a cross-sectional view taken along lines A-A in FIG. 20.
Figure 22:
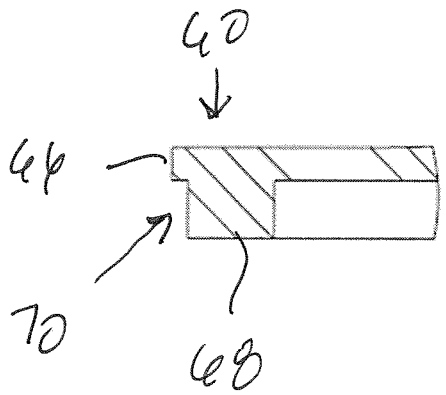
FIG. 22 is an enlarged cross-sectional view of the details of circle B in FIG. 21.
Figure 23:
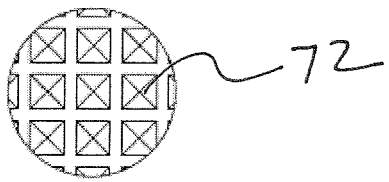
FIG. 23 is an enlarged plan view of the details of circle C in FIG. 20.
Figure 24:
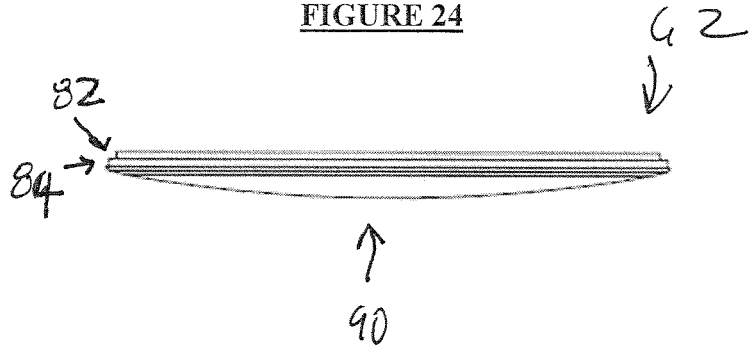
FIG. 24 is an elevational view of one of many forms of a base for a manhole cover assembly formed in accordance with a preferred embodiment of the present invention.
Figure 25:
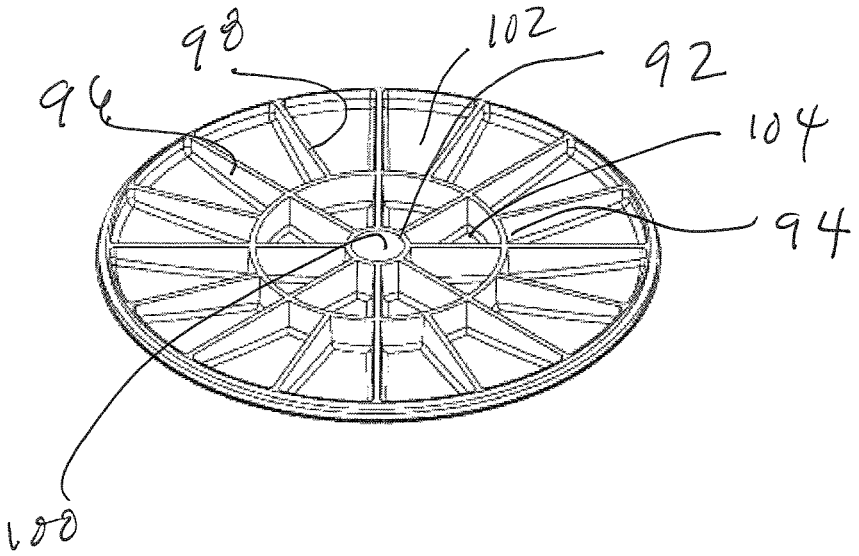
FIG. 25 is a perspective view of the base depicted in FIG. 24.
Figure 26:
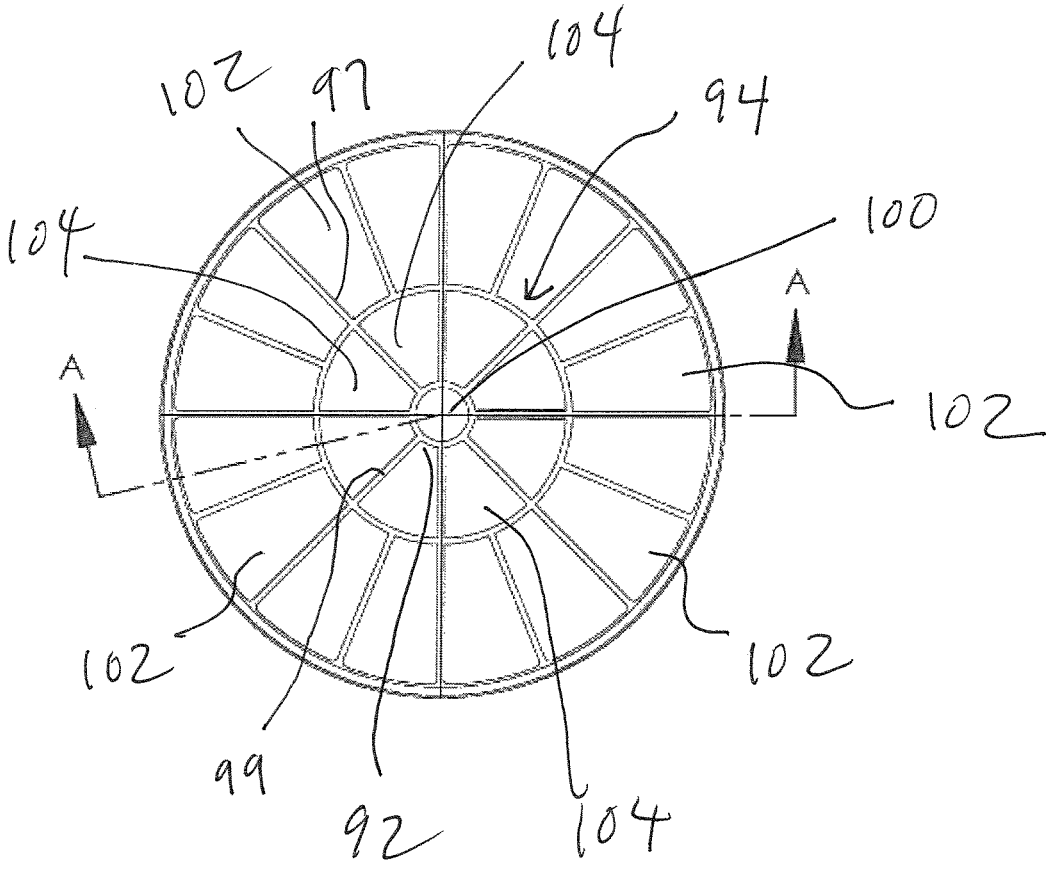
FIG. 26 is a top plan view of the base depicted in FIG. 24.
Figure 27:
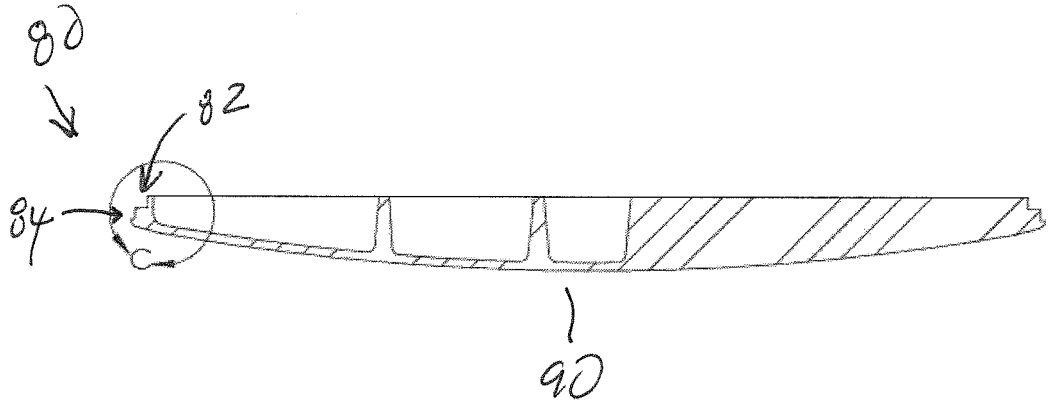
FIG. 27 is a cross-sectional view taken along lines A-A in FIG. 26.
Figure 28:
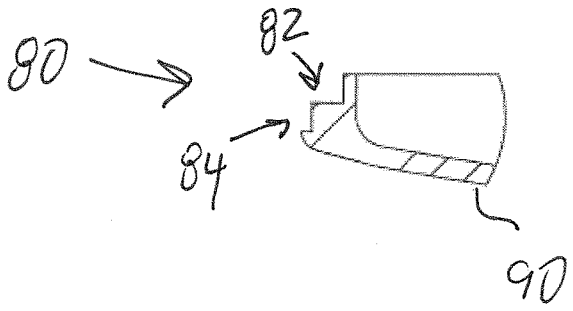
FIG. 28 is an enlarged cross-sectional view of the details of circle C in FIG. 27.
Figure 29:
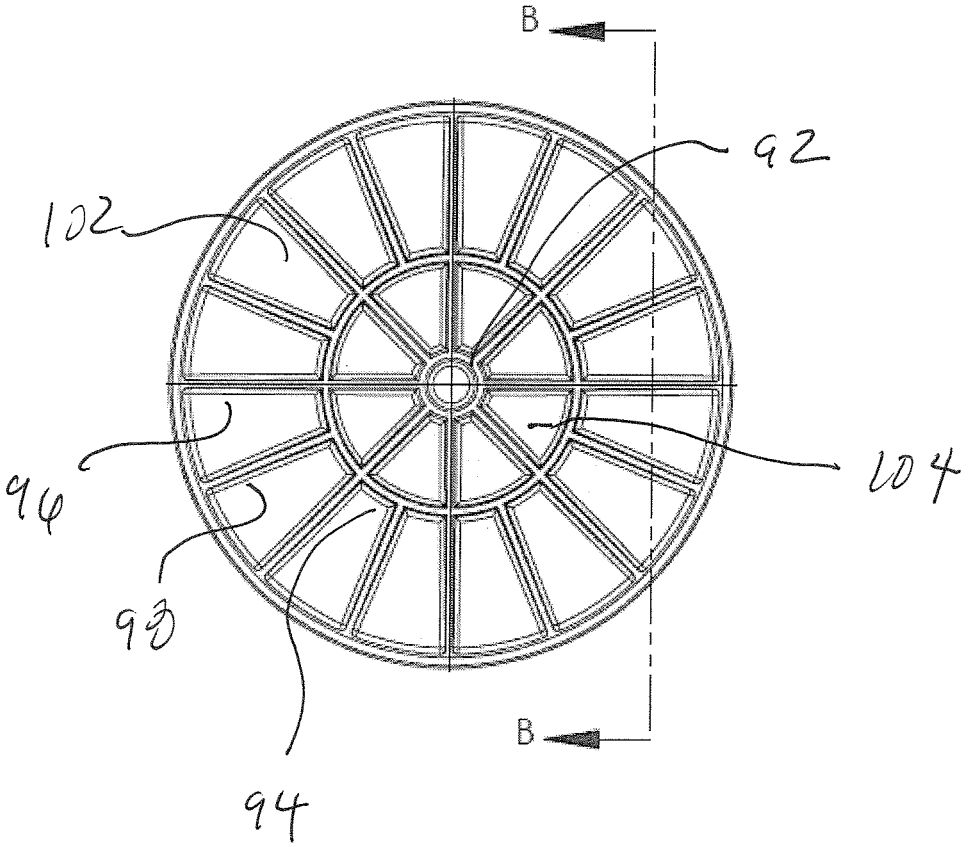
FIG. 29 is a plan view of a base formed in accordance with a preferred embodiment of the present invention.
Figure 30:
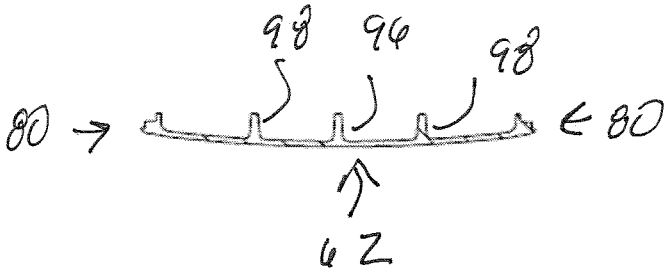
FIG. 30 is a cross-sectional view taken along lines B-B of FIG. 29.

Referring to FIG. 22, cover 60 preferably has a stepped outer peripheral annular portion that includes an annular lip 66 and inner annular member 68 forming a notch or step 70. Referring to FIGS. 20 and 23, cover 60 can be provided with an anti-skid surface in area 71 of cover 60 that includes pyramid shaped projections 72 extending upwardly that are designed to prevent a person from slipping on cover 60 when the individual walks across cover 60. Referring to FIG. 20, the outermost periphery 74 of cover 60 is free of the anti-skid surface.

Referring to, for example, FIGS. 19, 24, 27 and 28, base 62 includes a stepped annular portion 80 having an upper step 82 and a lower step 84 extending outwardly from upper step 82. An annular seal 86 is fixed to and supported by lower step 84 using an adhesive or other suitable fastening means. Seal 86 is configured to engage an inner peripheral surface of a corresponding manhole skirt/rim to provide a fluid tight seal between manhole cover assembly D and the corresponding manhole skirt/rim.

Figure 19:
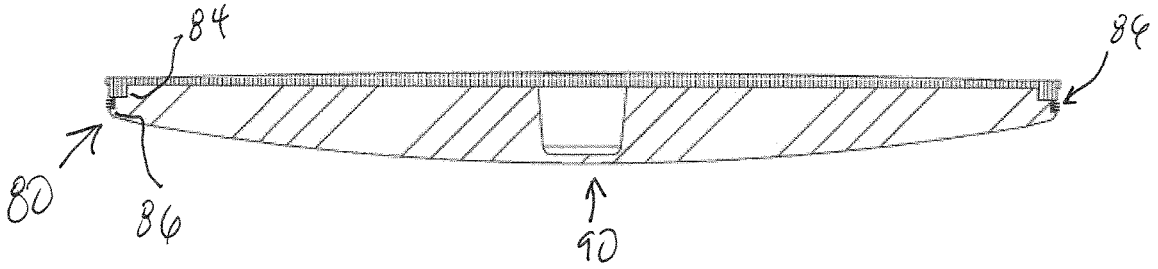
FIG. 19 is a cross-sectional view taken along lines A-A in FIG. 18.

Preferably, as seen in FIG. 19, annular member 68 of cover 60 rests on and is supported by upper step 82 of base 62. An adhesive can be applied between these adjacent members to fix cover 60 to base 62. Other fastening means can be used in place of adhesive or to supplement the adhesive. Further, an adhesive may be applied to the upper surface of the load bearing ribs described below.

Referring to FIGS. 19, 24, 27 and 30, preferably base 62 has a nonplanar and dome shaped bottom surface 90 surrounded by annular portion 80. Bottom surface 90 is continuous and free of openings. Referring to, for example, FIGS. 25, 26 and 29, base 62 has a centrally located inner collar 92 disposed in and surrounded by an outer collar 94.

Base 62 includes eight radially extending ribs 96. Each rib 96 has an innermost end that abuts a corresponding outer surface of inner collar 92 and an outermost end that abuts annular portion 80. Base 62 includes eight radially extending ribs 98. Each rib 98 has an innermost end that abuts a corresponding outer surface of collar 94 and an outermost end that abuts annular portion 80. Preferably, the outermost end of each of ribs 96 is spaced a distance from a center of base 62 equal to the distance the outermost ends of ribs 98 are spaced from the center of base 62.

Ribs 96 and 98 can be tapered to provide a draft angle (e.g., 5 or 6 degrees) to facilitate removal of base 62 from a mold. Each of ribs 96 and 98 is a loading bearing rib and has an upper surface which is shaped to be complementary to the shape of the corresponding portion of cover 60, so that the upper surface of each of the ribs contacts the lower surface of the corresponding portion of cover 60. For example, if the inner lower surface of cover 60 has a convex surface, ribs 96 and 98 will have an upper surface which is convex having the same or similar curvature as the corresponding portion of the inner lower surface of cover 60. It is to be understood that the number and configuration of ribs can be varied as desired.

Collars 92 and 94 and ribs 96 and 98 act with cover 60 to evenly distribute the load placed on manhole cover assembly D across the manhole cover assembly. Outer ribs 98 along with the outer portions 97 of ribs 96 prevent deflection of the portion of the cover extending between collar 94 and the edge of cover 60. Inner portions 99 of ribs 96 prevent deflection of the portion of the cover extending inwardly from collar 94. A plurality of voids 102 are provided between each of ribs 98 and the adjacent outer portion 97 of ribs 96. A plurality of voids 104 are provided between adjacent inner portions 99 of ribs 96. Base 62 of manhole cover assembly D can be used with an existing manhole cover (i.e., a cover installed in a fuel transfer station to dramatically increase the strength of the exiting manhole cover without the need for a new manhole cover). Like manhole assembly A, manhole assembly D is preferably free of structural foam. While collars 92 and 94 and ribs 96 and 98 are shown as being formed on the base, they could be formed on the cover or on an intermediate element positioned between the cover and a dome shaped base.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiments and have been written to preclude such a narrow construction using the principles of claim differentiation.

We claim:

1. A manhole cover assembly configured to be removably supported by a manhole skirt wherein upon removal of said manhole cover assembly an individual can access one or more components through an opening formed by the manhole skirt, said manhole cover assembly comprising:

(a) a cover having an upper surface configured to cover at least a major area of the opening formed by the manhole skirt when the manhole cover assembly is installed, wherein at least a portion of said cover forms an uppermost portion of said manhole cover assembly;

(b) a base for supporting said cover, said base being disposed below said upper surface of said cover, said base and said cover are separate pieces, said base having a main body portion, said main body portion forming at least a major portion of said base, said main body portion having a bottom surface having a substantially constant radius, said bottom surface including an inner surface portion located midway between directly opposing outermost segments of said base, said bottom surface of said main body portion being dome shaped wherein no portion of said bottom surface of said main body portion of said base is planar, said bottom surface of said main body portion forming a lowermost portion of said manhole cover assembly; and, (c) a plurality of ribs, at least a portion of each of said plurality of ribs being disposed between said upper surface of said cover and said bottom surface of said base, and, wherein each of said plurality of ribs having a bottom surface that contacts said bottom surface of said main body portion of said base, said cover and said plurality of ribs of said manhole cover assembly are configured and operably connected to prevent deflection of said cover when a predetermined load is applied to said cover and each of said plurality of ribs are loading bearing ribs.

2. The manhole cover assembly of claim 1, wherein:

(a) said plurality of ribs and said upper surface of said cover are formed as a single piece.

3. The manhole cover assembly of claim 1, wherein:

(a) said plurality of ribs are each formed from SMC.

4. The manhole cover assembly of claim 1, wherein:

(a) said cover includes an annular lip having an uppermost surface and a lowermost surface, a recess surrounded by said annular lip and an annular transitional section connecting an upper surface of said recess and said lowermost surface of said annular lip, said annular lip forming an outermost portion of said cover, said annular transition section is disposed between an outermost portion of each of said plurality of ribs and an innermost portion of said annular lip and wherein said upper surface of said recess is disposed between said uppermost surface of said annular lip and said lowermost surface of said annular lip and wherein at least a portion of each of said plurality of ribs is disposed in said recess.

5. The manhole cover assembly of claim 4, wherein:

(a) said cover has a cylindrical collar disposed in a central portion of said cover, an upper portion of said cylindrical collar is disposed in said recess of said cover and a lower portion of said cylindrical collar engages a corresponding inner surface of said main body portion of said base.

6. The manhole cover assembly of claim 5, wherein:

(a) said base has an annular lip having an uppermost surface and a lowermost surface, said annular lip of said base forms an outermost portion of said base, said uppermost surface of said annular lip of said base is disposed below a lowermost surface of said annular lip of said cover.

7. The manhole cover assembly of claim 1, wherein:

(a) said cover and said base are formed from a fiber reinforced thermoset material.

8. A manhole cover assembly configured to be removably supported by a manhole skirt wherein upon removal of said manhole cover assembly an individual can access one or more components through an opening formed by the manhole skirt, said manhole cover assembly comprising:

(a) a cover having an upper surface configured to at least substantially cover the opening formed by the manhole skirt when the manhole cover assembly is installed, wherein at least a portion of said cover forms an uppermost portion of said manhole cover assembly, said cover including a plurality of ribs, each of said plurality of ribs having a curved bottom surface, said cover including an outer peripheral lip having an uppermost surface and a lowermost surface, a recess entirely surrounded by said outer peripheral lip and a transitional section connecting an upper surface of said recess and said lowermost surface of said outer peripheral lip, said transitional section is disposed between an outermost portion of each of said plurality of ribs and an innermost portion of said outer peripheral lip and wherein said upper surface of said recess is disposed between said uppermost surface of said outer peripheral lip and said lowermost surface of said outer peripheral lip and wherein a portion of each of said plurality of ribs is disposed in said recess; and, (b) a base for supporting said cover, said base being disposed below said upper surface of said cover, said base and said cover are separate pieces, said base having a main body portion, said main body portion being dome shaped, said main body portion forming at least a major portion of said base and further forming an innermost portion of said base, said main body portion having an inner cavity for receiving said plurality of ribs, said innermost portion of said base forming a lowermost portion of said manhole cover assembly.

9. The manhole cover assembly of claim 8, wherein:

(a) said curved bottom surface of each of said plurality of ribs has a substantially constant radius.

10. The manhole cover assembly of claim 8, wherein:

(a) said base includes an outer peripheral lip surrounding said main body portion, said outer peripheral lip of said base includes an uppermost surface and a lowermost surface and wherein said uppermost surface of said outer peripheral lip of said base is disposed below said lowermost surface of said outer peripheral lip of said cover.

11. The manhole cover assembly of claim 8, wherein:

(a) said outer peripheral lip of said base extends and said outer peripheral lip of said cover each extend substantially horizontally.

12. The manhole cover assembly of claim 8, wherein:

(a) said base has a uniform thickness.

13. The manhole cover assembly of claim 8, wherein:

(a) said base is substantially circular and formed from a fiber reinforced thermoset material.

14. The manhole cover assembly of claim 13, wherein:

(a) said cover is substantially circular and formed from a fiber reinforced thermoset material.

15. A manhole cover assembly configured to be removably supported by a manhole skirt wherein upon removal of said manhole cover assembly an individual can access one or more components through an opening formed by the manhole skirt, said manhole cover assembly comprising:

(a) a cover having an upper surface configured to cover at least a portion of the opening formed by the manhole skirt when the manhole cover assembly is installed, wherein at least a portion of said cover forms an uppermost portion of said manhole cover assembly, said cover having an outermost peripheral lip;

(b) a base having an outermost peripheral lip disposed below said outermost peripheral lip of said cover, said base having a dome shaped portion, said dome shaped portion having a bottom surface, and said base and said cover are formed from the same material;

(c) an inner collar; and, (d) a plurality of ribs, each of said plurality of ribs being a loading bearing rib, each of said plurality of ribs including an innermost end and, said innermost end of each of said plurality of ribs abuts an outer surface of said inner collar, said plurality of ribs extending radially outward from said inner collar and said plurality of ribs being uniformly spaced about said inner collar and wherein said plurality of ribs are configured to act with said cover and said base of the manhole cover assembly to transfer evenly loads placed on the manhole cover assembly across the manhole cover assembly and wherein said plurality of ribs form at least a portion of one of said cover and said base, and wherein said base and said cover are separate pieces and a free end of each of said plurality of ribs contacts one of the following (i) an upper surface of the dome shaped portion of said base and, (ii) a lower surface of said cover.

16. The manhole cover assembly of claim 15, wherein:

(a) said base is fixed to said cover.

17. The manhole cover assembly of claim 15, wherein:

(a) said base and said cover are each formed from a fiber reinforced thermoset material.

18. The manhole cover assembly of claim 17, wherein:

(a) at least a major portion of a bottom surface of said base is dome shaped.

19. The manhole cover assembly of claim 15, wherein:

(a) said base and said cover are formed from SMC.

20. The manhole cover assembly of claim 19, wherein:

(a) said plurality of ribs includes a first set of ribs and a second set of ribs, each rib of said first set of ribs and each rib of said second set of ribs has an innermost end and an outermost end, said innermost end of each of said first ribs abuts an outer surface of said inner collar and said innermost end of each rib of said second set of ribs abuts an outer surface of an outer collar surrounding said inner collar.

21. The manhole cover assembly of claim 20, wherein:

(a) said outermost end of each rib of said first set of ribs is spaced a first distance from said inner collar and said outermost end of each rib of said second set of ribs are spaced from said inner collar a distance equal to said first distance.

* * * * *